US006069287A

United States Patent [19]

Ladwig et al.

[11] Patent Number: 6,069,287

[45] **Date of Patent: *May 30, 2000**

[54] PROCESS FOR SELECTIVELY PRODUCING LIGHT OLEFINS IN A FLUID CATALYTIC CRACKING PROCESS

[75] Inventors: Paul K. Ladwig, Randolph, N.J.; John Ernest Asplin, Southampton, United Kingdom; Gordon F. Stuntz, Baton Rouge, La.; William A. Wachter, Baton Rouge, La.; Brian Erik Henry, Baton Rouge, La.

[73] Assignee: Exxon Research and Engineering Co., Florham Park, N.J.

[ * ] Notice: This patent is subject to a terminal disclaimer.

[21] Appl. No.: 09/073,085

[22] Filed: May 5, 1998

[51] Int. Cl.[7] ..... C07C 4/06

[52] U.S. Cl. ..... 585/648; 585/649; 585/650; 585/651; 585/653; 208/135; 208/120.01; 208/72

[58] Field of Search ..... 585/648, 650, 585/649, 651, 653; 208/135, 120.01, 72

[56] References Cited

U.S. PATENT DOCUMENTS

| | | | |
|---|---|---|---|
| 3,928,172 | 12/1975 | Davis, Jr. et al. | 208/77 |
| 4,171,257 | 10/1979 | O'Rear et al. | 208/120 |
| 4,282,085 | 8/1981 | O'Rear et al. | 208/120 |
| 4,502,945 | 3/1985 | Olbrich et al. | 208/120 |
| 4,830,728 | 5/1989 | Herbst et al. | 208/78 |
| 4,865,718 | 9/1989 | Herbst et al. | 208/70 |
| 5,026,935 | 6/1991 | Leyshon et al. | 585/315 |
| 5,026,936 | 6/1991 | Leyshon et al. | 585/315 |
| 5,043,522 | 8/1991 | Leyshon et al. | 585/651 |
| 5,069,776 | 12/1991 | Biwas et al. | 208/120 |
| 5,160,424 | 11/1992 | Le et al. | 208/67 |
| 5,171,921 | 12/1992 | Gaffney et al. | 585/653 |
| 5,372,704 | 12/1994 | Harandi et al. | 208/74 |
| 5,389,232 | 2/1995 | Adewuyi et al. | 208/120 |
| 5,472,594 | 12/1995 | Tsang et al. | 208/114 |

FOREIGN PATENT DOCUMENTS

| | | | |
|---|---|---|---|
| 0347 003 B1 | 8/1996 | European Pat. Off. | C10G 11/05 |

*Primary Examiner*—Walter D. Griffin
*Assistant Examiner*—Nadine Preisch
*Attorney, Agent, or Firm*—Henry E. Naylor

[57] ABSTRACT

A process for selectively producing $C_2$–$C_4$ olefins from a catalytically cracked or thermally cracked naphtha stream. The naphtha stream is contacted with a catalyst containing from about 10 to 50 wt. % of a crystalline zeolite having an average pore diameter less than about 0.7 nanometers at reaction conditions which include temperatures from about 500 to 650° C. and a hydrocarbon partial pressure from about 10 to 40 psia.

16 Claims, No Drawings

PROCESS FOR SELECTIVELY PRODUCING LIGHT OLEFINS IN A FLUID CATALYTIC CRACKING PROCESS

FIELD OF THE INVENTION

The present invention relates to a process for selectively producing $C_2$–$C_4$ olefins from a catalytically cracked or thermally cracked naphtha stream. The naphtha stream is contacted with a catalyst containing from about 10 to 50 wt. % of a crystalline zeolite having an average pore diameter less than about 0.7 nanometers at reaction conditions which include temperatures from about 500 to 650° C. and a hydrocarbon partial pressure from about 10 to 40 psia.

BACKGROUND OF THE INVENTION

The need for low emissions fuels has created an increased demand for light olefins for use in alkylation, oligomerization, MTBE and ETBE synthesis processes. In addition, a low cost supply of light olefins, particularly propylene, continues to be in demand to serve as feedstock for polyolefin, particularly polypropylene production.

Fixed bed processes for light paraffin dehydrogenation have recently attracted renewed interest for increasing olefin production. However, these types of processes typically require relatively large capital investments as well as high operating costs. It is therefore advantageous to increase olefin yield using processes, which require relatively small capital investment. It would be particularly advantageous to increase olefin yield in catalytic cracking processes.

U.S. Pat. No. 4,830,728 discloses a fluid catalytic cracking (FCC) unit that is operated to maximize olefin production. The FCC unit has two separate risers into which a different feed stream is introduced. The operation of the risers is designed so that a suitable catalyst will act to convert a heavy gas oil in one riser and another suitable catalyst will act to crack a lighter olefin/naphtha feed in the other riser. Conditions within the heavy gas oil riser can be modified to maximize either gasoline or olefin production. The primary means of maximizing production of the desired product is by using a specified catalyst.

Also, U.S. Pat. No. 5,026,936 to Arco teaches a process for the preparation of propylene from $C_4$ or higher feeds by a combination of cracking and metathesis wherein the higher hydrocarbon is cracked to form ethylene and propylene and at least a portion of the ethylene is metathesized to propylene. See also, U.S. Pat. Nos. 5,026,935; 5,171,921 and 5,043,522.

U.S. Pat. No. 5,069,776 teaches a process for the conversion of a hydrocarbonaceous feedstock by contacting the feedstock with a moving bed of a zeolitic catalyst comprising a zeolite with a pore diameter of 0.3 to 0.7 nm, at a temperature above about 500° C. and at a residence time less than about 10 seconds. Olefins are produced with relatively little saturated gaseous hydrocarbons being formed. Also, U.S. Pat. No. 3,928,172 to Mobil teaches a process for converting hydrocarbonaceous feedstocks wherein olefins are produced by reacting said feedstock in the presence of a ZSM-5 catalyst.

A problem inherent in producing olefin products using FCC units is that the process depends on a specific catalyst balance to maximize production of light olefins while also achieving high conversion of the 650° F. plus feed components. In addition, even if a specific catalyst balance can be maintained to maximize overall olefin production, olefin selectivity is generally low due to undesirable side reactions, such as extensive cracking, isomerization, aromatization and hydrogen transfer reactions. Light saturated gases produced from undesirable side reactions result in increased costs to recover the desirable light olefins. Therefore, it is desirable to maximize olefin production in a process that allows a high degree of control over the selectivity to $C_2$–$C_4$ olefins.

SUMMARY OF THE INVENTION

In accordance with the present invention there is provided a process for the selective production of $C_2$ to $C_4$ olefins which comprises contacting a catalytically or thermally cracked naphtha containing paraffins and olefins with a catalyst containing 10 to 50 wt. % of a crystalline zeolite having an average pore diameter less than about 0.7 nm at conditions including a temperature from about 500° to 650° C., a hydrocarbon partial pressure of 10 to 40 psia, a hydrocarbon residence time of 1 to 10 seconds, and a catalyst to feed weight ratio of about 2 to 10, wherein no more than about 20 wt. % of paraffins are converted to olefins.

In a preferred embodiment there is provided a process for selectively producing $C_2$ to $C_4$ olefins in a process unit comprised of a reaction zone, a stripping zone, and a catalyst regeneration zone. The naphtha stream is contacted in the reaction zone, which contains a bed of catalyst, preferably in the fluidized state. The catalyst is comprised of a zeolite having an average pore diameter of less than about 0.7 nm and wherein the reaction zone is operated at a temperature from about 500° to 650° C., a hydrocarbon partial pressure of 10 to 40 psia, a hydrocarbon residence time of 1 to 10 seconds, and a catalyst to feed weight ratio of about 2 to 10, wherein no more than about 20 wt. % of paraffins are converted to olefins.

In another preferred embodiment of the present invention the catalyst is a ZSM-5 type catalyst.

In still another preferred embodiment of the present invention the feedstock contains about 10 to 30 wt. % paraffins, and from about 20 to 70 wt. % olefins.

In yet another preferred embodiment of the present invention the reaction zone is operated at a temperature from about 525° C. to about 600° C.

DETAILED DESCRIPTION OF THE INVENTION

Feedstreams which are suitable for producing the relatively high $C_2$, $C_3$, and $C_4$ olefin yields are those streams boiling in the naphtha range and containing from about 5 wt. % to about 35 wt. %, preferably from about 10 wt. % to about 30 wt. %, and more preferably from about 10 to 25 wt. % paraffins, and from about 15 wt. %, preferably from about 20 wt. % to about 70 wt. % olefins. The feed may also contain naphthenes and aromatics. Naphtha boiling range streams are typically those having a boiling range from about 65° F. to about 430° F., preferably from about 65° F. to about 300° F. The naphtha can be a thermally cracked or a catalytically cracked naphtha. Such streams can be derived from any appropriate source, for example, they can be derived from the fluid catalytic cracking (FCC) of gas oils and resids, or they can be derived from delayed or fluid coking of resids. It is preferred that the naphtha streams used in the practice of the present invention be derived from the fluid catalytic cracking of gas oils and resids. Such naphthas are typically rich in olefins and/or diolefins and relatively lean in paraffins.

The process of the present invention is performed in a process unit comprised of a reaction zone, a stripping zone, a catalyst regeneration zone, and a fractionation zone. The naphtha feedstream is fed into the reaction zone where it contacts a source of hot, regenerated catalyst. The hot catalyst vaporizes and cracks the feed at a temperature from about 500° C. to 650° C., preferably from about 500° C. to 600° C. The cracking reaction deposits carbonaceous hydrocarbons, or coke, on the catalyst, thereby deactivating the catalyst. The cracked products are separated from the coked catalyst and sent to a fractionator. The coked catalyst is passed through the stripping zone where volatiles are stripped from the catalyst particles with steam. The stripping can be preformed under low severity conditions in order to retain adsorbed hydrocarbons for heat balance. The stripped catalyst is then passed to the regeneration zone where it is regenerated by burning coke on the catalyst in the presence of an oxygen containing gas, preferably air. Decoking restores catalyst activity and simultaneously heats the catalyst to, e.g., 650° C. to 750° C. The hot catalyst is then recycled to the reaction zone to react with fresh naphtha feed. Flue gas formed by burning coke in the regenerator may be treated for removal of particulates and for conversion of carbon monoxide, after which the flue gas is normally discharged into the atmosphere. The cracked products from the reaction zone are sent to a fractionation zone where various products are recovered, particularly a $C_3$ fraction and a $C_4$ fraction.

While attempts have been made to increase light olefins yields in the FCC process unit itself, the practice of the present invention uses its own distinct process unit, as previously described, which receives naphtha from a suitable source in the refinery. The reaction zone is operated at process conditions that will maximize $C_2$ to $C_4$ olefin, particularly propylene, selectivity with relatively high conversion of $C_5$+ olefins. Catalysts suitable for use in the practice of the present invention are those which are comprised of a crystalline zeolite having an average pore diameter less than about 0.7 nanometers (nm), said crystalline zeolite comprising from about 10 wt. % to about 50 wt. % of the total fluidized catalyst composition. It is preferred that the crystalline zeolite be selected from the family of medium pore size (<0.7 nm) crystalline aluminosilicates, otherwise referred to as zeolites. Of particular interest are the medium pore zeolites with a silica to alumina molar ratio of less than about 75:1, preferably less than about 50:1, and more preferably less than about 40:1. The pore diameter also sometimes referred to as effective pore diameter can be measured using standard adsorption techniques and hydrocarbonaceous compounds of known minimum kinetic diameters. See Breck, *Zeolite Molecular Sieves,* 1974 and Anderson et al., J. Catalysis 58, 114 (1979), both of which are incorporated herein by reference.

Medium pore size zeolites that can be used in the practice of the present invention are described in "Atlas of Zeolite Structure Types", eds. W. H. Meier and D. H. Olson, Butterworth-Heineman, Third Edition, 1992, which is hereby incorporated by reference. The medium pore size zeolites generally have a pore size from about 0.5 nm, to about 0.7 nm and include for example, MFI, MFS, MEL, MTW, EUO, MTT, HEU, FER, and TON structure type zeolites (IUPAC Commission of Zeolite Nomenclature). Non-limiting examples of such medium pore size zeolites, include ZSM-5, ZSM-12, ZSM-22, ZSM-23, ZSM-34, ZSM-35, ZSM-38, ZSM-48, ZSM-50, silicalite, and silicalite 2. The most preferred is ZSM-5, which is described in U.S. Pat. Nos. 3,702,886 and 3,770,614. ZSM-11 is described in U.S. Pat. No. 3,709,979; ZSM-12 in U.S. Pat. No. 3,832,449; ZSM-21 and ZSM-38 in U.S. Pat. No. 3,948,758; ZSM-23 in U.S. Pat. No. 4,076,842; and ZSM-35 in U.S. Pat. No. 4,016,245. All of the above patents are incorporated herein by reference. Other suitable medium pore size zeolites include the silicoaluminophosphates (SAPO), such as SAPO-4 and SAPO-11 which is described in U.S. Pat. No. 4,440,871; chromosilicates; gallium silicates; iron silicates; aluminum phosphates (ALPO), such as ALPO-11 described in U.S. Pat. No. 4,310,440; titanium aluminosilicates (TASO), such as TASO-45 described in EP-A No. 229,295; boron silicates, described in U.S. Pat. No. 4,254,297; titanium aluminophosphates (TAPO), such as TAPO-11 described in U.S. Pat. No. 4,500,651; and iron aluminosilicates. In one embodiment of the present invention the Si/Al ratio of said zeolites is greater than about 40.

The medium pore size zeolites can include "crystalline admixtures" which are thought to be the result of faults occurring within the crystal or crystalline area during the synthesis of the zeolites. Examples of crystalline admixtures of ZSM-5 and ZSM-11 are disclosed in U.S. Pat. No. 4,229,424 which is incorporated herein by reference. The crytalline admixtures are themselves medium pore size zeolites and are not to be confused with physical admixtures of zeolites in which distinct crystals of crystallites of different zeolites are physically present in the same catalyst composite or hydrothermal reaction mixtures.

The catalysts of the present invention are held together with an inorganic oxide matrix component. The inorganic oxide matrix component binds the catalyst components together so that the catalyst product is hard enough to survive interparticle and reactor wall collisions. The inorganic oxide matrix can be made from an inorganic oxide sol or gel which is dried to "glue" the catalyst components together. Preferably, the inorganic oxide matrix is not catalytically active and will be comprised of oxides of silicon and aluminum. It is also preferred that separate alumina phases be incorporated into the inorganic oxide matrix. Species of aluminum oxyhydroxides-g-alumina, boehmite, diaspore, and transitional aluminas such as a-alumina, b-alumina, g-alumina, d-alumina, e-alumina, k-alumina, and r-alumina can be employed. Preferably, the alumina species is an aluminum trihydroxide such as gibbsite, bayerite, nordstrandite, or doyelite. The matrix material may also contain phosphorous or aluminum phosphate.

Preferred process conditions include temperatures from about 500° C. to about 650° C., preferably from about 525° C. to 600° C., hydrocarbon partial pressures from about 10 to 40 psia, preferably from about 20 to 35 psia; and a catalyst to naphtha (wt/wt) ratio from about 3 to 12, preferably from about 4 to 10, where catalyst weight is total weight of the catalyst composite. It is also preferred that steam be concurrently introduced with the naphtha stream into the reaction zone, with the steam comprising up to about 50 wt. % of the hydrocarbon feed. Also, it is preferred that the naphtha residence time in the reaction zone be less than about 10 seconds, for example from about 1 to 10 seconds. The above conditions will be such that at least about 60 wt. % of the $C_5$+ olefins in the naphtha stream are converted to $C_4$− products and less than about 25 wt. %, preferably less than about 20 wt. % of the paraffins are converted to $C_4$− products, and that propylene comprises at least about 90 mol %, preferably greater than about 95 mol % of the total $C_3$ reaction products with the weight ratio of propylene/total $C_2$− products greater than about 3.5. It is also preferred that ethylene comprises at least about 90 mol % of the $C_2$ products, with the weight ratio of propylene:ethylene being greater than about 4, and that the "full range" $C_5$+ naphtha product is enhanced in both motor and research octanes relative to the naphtha feed. It is within the scope of this invention that the catalysts be precoked prior to introduction of feed in order to further improve the selectivity to propylene. It is also within the scope of this invention that an effective amount of single ring aromatics be fed to the reaction zone to also improve the selectivity of propylene vs ethylene. The aromatics may be from an external source such as a reforming process unit or they may consist of heavy naphtha recycle product from the instant process.

The following examples are presented for illustrative purposes only and are not to be taken as limiting the present invention in any way.

EXAMPLES 1–12

The following examples illustrate the criticality of process operating conditions for maintaining chemical grade propylene purity with samples of cat naphtha cracked over ZCAT-40 (a catalyst that contains ZSM-5) which had been steamed at 1500° F. for 16 hrs to simulate commercial equilibrium. Comparison of Examples 1 and 2 show that increasing Cat/Oil ratio improves propylene yield, but sacrifices propylene purity. Comparison of Examples 3 and 4 and 5 and 6 shows reducing oil partial pressure greatly improves propylene purity without compromising propylene yield. Comparison of Examples 7 and 8 and 9 and 10 shows increasing temperature improves both propylene yield and purity. Comparison of Examples 11 and 12 shows decreasing cat residence time improves propylene yield and purity. Example 13 shows an example where both high propylene yield and purity are obtained at a reactor temperature and cat/oil ratio that can be achieved using a conventional FCC reactor/regenerator design for the second stage.

TABLE 1

| Example | Feed Olefins, wt % | Temp. ° C. | Cat/ Oil | Oil psia | Oil Res. Time, sec | Cat Res. Time, sec | Wt. % $C_3^=$ | Wt. % $C_3^-$ | Propylene Purity, % |
|---|---|---|---|---|---|---|---|---|---|
| 1 | 38.6 | 566 | 4.2 | 36 | 0.5 | 4.3 | 11.4 | 0.5 | 95.8% |
| 2 | 38.6 | 569 | 8.4 | 32 | 0.6 | 4.7 | 12.8 | 0.8 | 94.1% |
| 3 | 22.2 | 510 | 8.8 | 18 | 1.2 | 8.6 | 8.2 | 1.1 | 88.2% |
| 4 | 22.2 | 511 | 9.3 | 38 | 1.2 | 5.6 | 6.3 | 1.9 | 76.8% |
| 5 | 38.6 | 632 | 16.6 | 20 | 1.7 | 9.8 | 16.7 | 1.0 | 94.4% |
| 6 | 38.6 | 630 | 16.6 | 13 | 1.3 | 7.5 | 16.8 | 0.6 | 96.6% |
| 7 | 22.2 | 571 | 5.3 | 27 | 0.4 | 0.3 | 6.0 | 0.2 | 96.8% |
| 8 | 22.2 | 586 | 5.1 | 27 | 0.3 | 0.3 | 7.3 | 0.2 | 97.3% |
| 9 | 22.2 | 511 | 9.3 | 38 | 1.2 | 5.6 | 6.3 | 1.9 | 76.8% |
| 10 | 22.2 | 607 | 9.2 | 37 | 1.2 | 6.0 | 10.4 | 2.2 | 82.5% |
| 11 | 22.2 | 576 | 18.0 | 32 | 1.0 | 9.0 | 9.6 | 4.0 | 70.6% |
| 12 | 22.2 | 574 | 18.3 | 32 | 1.0 | 2.4 | 10.1 | 1.9 | 84.2% |
| 13 | 38.6 | 606 | 8.5 | 22 | 1.0 | 7.4 | 15.0 | 0.7 | 95.5% |

| Example | Wt. % $C_2^-$ | Wt. % $C_2^-$ | Ratio of $C_3^-$ to $C_2^-$ | Ratio of $C_3^=$ to $C_2^-$ | Wt. % $C_3^=$ |
|---|---|---|---|---|---|
| 1 | 2.35 | 2.73 | 4.9 | 4.2 | 11.4 |
| 2 | 3.02 | 3.58 | 4.2 | 3.6 | 12.8 |
| 3 | 2.32 | 2.53 | 3.5 | 3.2 | 8.2 |
| 4 | 2.16 | 2.46 | 2.9 | 2.6 | 6.3 |
| 5 | 6.97 | 9.95 | 2.4 | 1.7 | 16.7 |
| 6 | 6.21 | 8.71 | 2.7 | 1.9 | 16.8 |
| 7 | 1.03 | 1.64 | 5.8 | 3.7 | 6.0 |
| 8 | 1.48 | 2.02 | 4.9 | 3.6 | 7.3 |
| 9 | 2.16 | 2.46 | 2.9 | 2.6 | 6.3 |
| 10 | 5.21 | 6.74 | 2.0 | 1.5 | 10.4 |
| 11 | 4.99 | 6.67 | 1.9 | 1.4 | 9.6 |
| 12 | 4.43 | 6.27 | 2.3 | 1.6 | 10.1 |
| 13 | 4.45 | 5.76 | 3.3 | 2.6 | 15.0 |

$C_2^- = CH_4 + C_2H_4 + C_2H_6$

The above examples (1,2,7 and 8) show that $C_3^=/C_2^=>4$ and $C_3^=/C_2^->3.5$ can be achieved by selection of suitable reactor conditions.

EXAMPLES 14–17

The cracking of olefins and paraffins contained in naphtha streams (e.g. FCC naphtha, coker naphtha) over small or medium pore zeolites such as ZSM-5 can produce significant amounts of ethylene and propylene. The selectivity to ethylene or propylene and selectivity of propylene to propane varies as a function of catalyst and process operating conditions. It has been found that propylene yield can be increased by co-feeding steam along with cat naphtha to the reactor. The catalyst may be ZSM-5 or other small or medium pore zeolites. Table 2 below illustrates the increase in propylene yield when 5 wt. % steam is co-fed with an- FCC naphtha containing 38.8 wt % olefins. Although propylene yield increased, the propylene purity is diminished. Thus, other operating conditions may need to be adjusted to maintain the targeted propylene selectivity.

TABLE 2

| Example | Steam Co-feed | Temp. C. | Cat/ Oil | Oil psia | Oil Res. Time, sec | Cat Res. Time, sec | Wt % Propylene | Wt % Propane | Propylene Purity, % |
|---|---|---|---|---|---|---|---|---|---|
| 14 | No | 630 | 8.7 | 18 | 0.8 | 8.0 | 11.7 | 0.3 | 97.5% |
| 15 | Yes | 631 | 8.8 | 22 | 1.2 | 6.0 | 13.9 | 0.6 | 95.9% |
| 16 | No | 631 | 8.7 | 18 | 0.8 | 7.8 | 13.6 | 0.4 | 97.1% |
| 17 | Yes | 632 | 8.4 | 22 | 1.1 | 6.1 | 14.6 | 0.8 | 94.8% |

What is claimed is:

1. A process for the selective production of $C_2$ to $C_4$ olefins which comprises feeding a catalytically or thermally cracked naphtha feedstock containing about 10 to 30 wt. % paraffins and from about 15 to 70 wt. % olefins and steam into a reaction zone and reacting the naphtha with a catalyst containing 10 to 50 wt. % of a crystalline zeolite having an average pore diameter less than about 0.7 nm at conditions including a temperature from about 500° to 650° C., a hydrocarbon partial pressure of 10 to 40 psia, a hydrocarbon residence time of 1 to 10 seconds, and a catalyst to feed ratio of about 2 to 10, wherein no more than about 20 wt. % of paraffins are converted to olefins wherein propylene comprises at least about 90 mol. % of the total $C_3$ products.

2. A process for selectively producing $C_2$ to $C_4$ olefins in a process unit comprised of a reaction zone, a stripping zone, and a catalyst regeneration zone, wherein naphtha stream containing about 10 to 30 wt. % paraffins and from about 15 to 70 wt. % olefins is contacted in the reaction zone which contains a bed of catalyst, preferably in the fluidized state, which catalyst is comprised of a crystalline zeolite having an average pore diameter of less than about 0.7 nm and wherein the reaction zone is operated at a temperature from about 500° to 650° C., a hydrocarbon partial pressure of 10 to 40 psia, a hydrocarbon residence time of 1 to 10 seconds, and a catalyst to feed ratio, by weight, of about 4 to 10, wherein no more than about 20 wt. % of paraffins are converted to olefins, wherein propylene comprises at least about 90 mol. % of the total $C_3$ products.

3. The process of claim 2 wherein the crystalline zeolite is ZSM-5.

4. The process of claim 3 wherein the reaction temperature is from about 500° C. to about 600° C.

5. The process of claim 3 wherein at least about 60 wt. % of the $C_5$+ olefins in the feedstream are converted to $C_4$− products and less than about 25 wt. % of the paraffins are converted to $C_4$− products.

6. The process of claim 1 wherein the weight ratio of propylene to total $C_2$− products is greater than about 3.5.

7. The process of claim 6 wherein the weight ratio of propylene to total $C_2$− products is greater than about 4.0.

8. A process for selectively producing $C_2$ to $C_4$ olefins in a process unit comprised of a reaction zone, a stripping zone, and a catalyst regeneration zone, wherein naphtha stream containing about 10 to 30 wt. % paraffins and from about 15 to 70 wt. % olefins is contacted in the reaction zone which contains a bed of catalyst, preferably in the fluidized state, which catalyst is comprised of a crystalline zeolite having an average pore diameter of less than about 0.7 nm and wherein the reaction zone is operated at a temperature from about 500° to 650° C., a hydrocarbon partial pressure of 10 to 40 psia, a hydrocarbon residence time of 1 to 10 seconds, and a catalyst to feed ratio, by weight, of about 4 to 10, wherein no more than about 20 wt. % of paraffins are converted to olefins.

9. The process of claim 8 wherein the crystalline zeolite is selected from the ZSM series.

10. The process of claim 9 wherein the crystalline zeolite is ZSM-5.

11. The process of claim 10 wherein the reaction temperature is from about 500° C. to about 600° C.

12. The process of claim 11 wherein at least about 60 wt. % of the $C_5$+ olefins in the feedstream is converted to $C_4$− products and less than about 25 wt. % of the paraffins are converted to $C_4$− products.

13. The process of claim 1 wherein the weight ratio of propylene to total $C_2$− products is greater than about 3.5.

14. The process of claim 13 wherein the weight ratio of propylene to total $C_2$− products is greater than about 4.0.

15. The process of claim 1 wherein propylene comprises at least about 95 mol. % of the total of $C_3$ products.

16. The process of claim 8 wherein propylene comprises at least about 95 mol. % of the total of $C_3$ products.

* * * * *